United States Patent [19]

Klynas

[11] Patent Number: 4,479,412

[45] Date of Patent: Oct. 30, 1984

[54] MULTIPLE DRUM PAD ISOLATION

[75] Inventor: Scott S. Klynas, Simi Valley, Calif.

[73] Assignee: Mattel, Inc., Hawthorne, Calif.

[21] Appl. No.: 452,576

[22] Filed: Dec. 23, 1982

Related U.S. Application Data

[63] Continuation-in-part of Ser. No. 335,985, Dec. 30, 1981, Pat. No. 4,418,598.

[51] Int. Cl.[3] ..... G10H 3/14

[52] U.S. Cl. ..... 84/1.04; 84/1.14; 84/DIG. 12; 84/DIG. 24

[58] Field of Search ..... 84/1.04, 1.06, 1.07, 84/1.08, 1.14, 411 R, 421, DIG. 12, DIG. 24

[56] References Cited

U.S. PATENT DOCUMENTS 3,712,951 1/1973 Rickard ..... 84/DIG. 24

3,956,959 5/1976 Ebihara et al. ..... 84/DIG. 12

4,226,156 10/1980 Hyakutake ..... 84/DIG. 12

*Primary Examiner*—S. J. Witkowski

*Attorney, Agent, or Firm*—Ronald M. Goldman; James G. O'Neill; Max E. Shirk

[57] ABSTRACT

An electronic percussion synthesizer is disclosed which includes a plurality of pressure transducers, each representing a different percussive musical instrument. Each transducer is responsive to an external striking force for generating analog pulses, each pulse representing one beat of the respective musical instrument. The transducers are mounted to a synthesizer housing in a manner which mechanically isolates the transducers from each other. Each transducer is supported within a pair of housing portions by a resilient coupler maintained in compression between the interior surfaces of the housing portions.

6 Claims, 4 Drawing Figures

10
12
14
16
18
20
21
22
23
24
25
26
27
28
29
30
31
32
33
34
35
36
37
38
40
42
44
46
48
50
52
54
56
58
3
3

40
60
64
66
68
70
72
74
76
78
80
81
82

MULTIPLE DRUM PAD ISOLATION

This is a continuation in part of application Ser. No. 335,985, filed Dec. 30, 1981, and now U.S. Pat. No. 4,418,598, in the name of Scott Steven Klynas and assigned to the assignee of the present invention.

BACKGROUND OF THE INVENTION

This invention relates to music synthesizers, and more particularly to an electronic music synthesizer capable of synthesizing the sounds of percussion instruments.

Over the years, many electronic music instruments have been developed which generate sound entirely by electronic means. These devices, generally categorized as music synthesizers, generate electronic signals which are shaped and blended together to create different types of waveforms which can be amplified and played through conventional speakers to create different types of sounds.

Many of these prior art music synthesizers employ a keyboard for entering the musical notes to be synthesized. A variety of controls may also be provided to cause the synthesizer to play predetermined rhythm patterns. Generally, the musical notes entered using the keyboard produce sounds simulating a keyboard controlled musical instrument such as a piano or an organ. The predetermined rhythm patterns, on the other hand, may be designed to produce sounds simulating percussion musical instruments such as drums. The tempo of the synthesized music is usually established by playing one of the predetermined rhythm patterns as background music and by adjusting the speed of the rhythm pattern using a tempo control. The user then plays the keyboard notes in time to the preset rhythm tempo. The musical notes and rhythm patterns are usually all played at the same amplitude which is adjusted using a volume control. A typical music synthesizer of the type described above is disclosed in U.S. Pat. No. 4,226,155, issued Oct. 7, 1980, and assigned to the assignee of the present invention.

In recent years, music synthesizers have been developed which are capable of recording the musical notes played. The user may then play back the recorded notes in the form of a tune. To record a new tune, it is generally necessary to erase the tune previously recorded Because of the manner in which percussion instruments (such as drums and cymbals) are played, many prior art music synthesizers do not accurately synthesize such instruments. For example, a musician generally develops percussion rhythms one beat at a time and then interleaves several of these rhythms together to produce musical phrases. The beat of one of these rhythms is usually used to establish the tempo of the succeeding rhythms. The musician may also alter the amplitude of each percussion beat. The amplitude of each beat is generally controlled by the amount of force used to strike the instrument surface. The ability to alter the amplitude of each beat enables the musician to enhance the tonal quality of the music.

Generally, prior art synthesizers capable of recording musical notes cannot be used to develop percussion rhythms in the same manner as they are developed using a conventional percussion instrument. This is so because these prior art synthesizers generally do not include a surface which may be struck in the manner of a percussion instrument to produce a percussion beat.

Many prior art synthesizers are only capable of recording one rhythm at a time, so they cannot be used to interleave a plurality of previously developed rhythms with newly developed rhythms. Further, prior art synthesizers generally do not have the ability to vary the amplitude of individual percussion beats.

It is accordingly an object of the present invention to prove a new and improved electronic percussion synthesizer.

It is another object of the present invention to provide an improved structure for a percussion synthesizer which reduces the degree of interaction between multiple percussion transducers.

SUMMARY OF THE INVENTION

Briefly stated and in accordance with the presently preferred embodiment of the invention, the foregoing and other objects are accomplished by providing an electronic percussion sythesizer which includes a plurality of pressure tranducers each mounted within a drum housing having a striking surface designed to represent the striking surface of a percussion instrument. Each transducer is responsive to an external striking force for generating an analog drum signal comprising analog drum pulses each representing one beat of the respective musical instrument. The amplitude of each pulse is proportional to the magnitude of the striking force.

The individual drum housings are mounted to a common synthesizer housing in a manner which mechanically isolates each transducer from the other transducers so that the force striking one transducer does not cause any of the other transducers to produce a pulse.

Sound generating circuits are provided which are responsive to the analog pulses for generating sounds comprising the beat of the respective musical instrument. The amplitude of the sound generated is proportional to the amplitude of the respective analog pulse.

The synthesizer of the present invention also includes storage and playback circuitry for digitally storing a series of pulses, each pulse representing a percussion beat; for playing back the stored pulses; and for storing additional pulses in an interleaving manner. The storage and playback circuitry includes a digital memory having sequentially addressable memory locations, a tempo control circuit for establishing a clock rate at which the memory locations are addressed, and latch circuits responsive to the respective analog drum signals for latching into a first state in response to the occurrence of an analog drum pulse.

A computer circuit, responsive to the tempo control circuit and the latch circuit, interrogates and resets the latch at the clock rate established by the tempo control circuit. The computer circuit also sequentially addresses the memory locations in a recirculating loop at this same clock rate. The computer circuit generates a beat signal in the form of a beat pulse if the latch is in the first state when it is interrogated, and stores the beat pulse in the addressed memory location if that location does not already contain the beat pulse.

The sound generating circuits are responsive to the computer circuit and generate a sound comprising the beat of the respective musical instrument if the memory location addressed contains the beat pulse.

Other objects, features and advantages of the invention will become apparent from a reading of the specification taken in conjunction with the drawings in which like reference numerals refer to like elements in the several views.

DESCRIPTION OF THE PREFERRED EMBODIMENT

Figure 1:
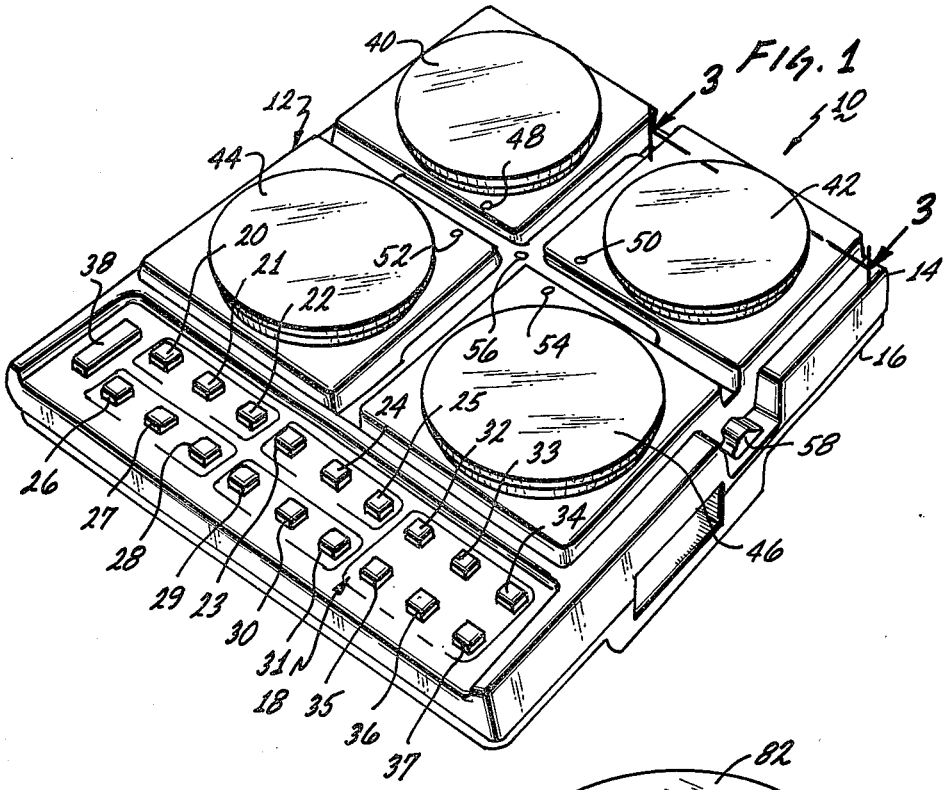
FIG. 1 is a perspective view of the electronic percussion synthesizer constructed in accordance with the present invention.

FIG. 1 shows a perspective view of an electronic percussion synthesizer 10 constructed in accordance with the present invention. The synthesizer 10 includes a housing 12 having an upper section 14 and a lower section 16. A keyboard 18 is mounted to the housing 12 and includes nineteen keys 20–38. Four drums 40, 42, 44 and 46 are provided which are mounted through openings in the upper section 14 of the housing 12. The drum 40 is designated as a first Tom-Tom drum; the drum 42 as a cymbal; the drum 44 as a snare drum; and the drum 46 as a second Tom-Tom drum having a lower pitch then the first Tom-Tom drum. Striking the surface of one of the drums 40–46 causes the synthesizer 10 to immediately generate a sound representing one beat of the designated percussion instrument. It is a feature of the synthesizer 10 that the harder the drums 40–46 are struck, the greater the amplitude of the sounds generated by the synthesizer 10. The drums 40–46 may be played using hands or conventional drum sticks, and may be played alone or in combination with the keys 20–38 of the keyboard 18 to produce a wide range of percussion sounds.

The synthesizer 10 produces sounds be generating two channels of electrical signals representative of those sounds. These signals are provided to an electrical connector (not shown) mounted to the housing 12. The user may connect stereo headphones or a stereo sound system to this connector to provide audible signals. A volume control 58 is provided to adjust the amplitude of the signals provided to the connector. A tuning control (not shown) is also provided to adjust the pitch of the first Tom-Tom drum. A second connector (not shown) is also provided for connecting foot pedals which may be used to control several of the functions of the synthesizer 10.

The electronic circuitry within the synthesizer 10 is powered by batteries which are inserted into a battery compartment (not shown) within the housing 12. Five visual indicators in the form of light emitting diodes (LEDs) 48, 50, 52, 54 and 56 are mounted through the upper section 14 of the housing 12. One of the four LEDs 48–54 is positioned adjacent each of the respective drums 40–46 and is caused to flash whenever the synthesizer 10 generates a beat representative of the sound of that respective drum. The function of the fifth and centrally located LED 56 is described below.

The function of each of the keys 20–38 of the keyboard 18 will now be described. The keys 20–31 are used to cause the synthesizer 10 to generate beat patterns which simulate the sounds of the four percussion instruments represented by the four drums 40–46. The three keys 20–22 are grouped in an area of the keyboard 18 labeled Tom-Tom 1; the three keys 23–25, in an area labeled cymbal and memory; the three keys 26–28, in an area labeled snare; and the three keys 29–31, in an area labeled Tom-Tom 2.

Each of the three keys 20, 21 and 22 is used to initiate rhythm sounds of the first Tom-Tom drum. Pressing the key 20 initiates a series of evenly spaced drum beats at a slow rate; pressing the key 21 initiates a medium rate; and pressing the key 22 initiates a fast rate. The selected series of beats is generated as long as the respective key is pressed. A single drum beat can be initiated by quickly tapping one of the keys, such as the key 20. The keys 20, 21 and 22 may also be used in combination with each other to cause the synthesizer 10 to generate a variety of other predetermined rhythm patterns. For example, pressing simultaneously the keys 20 and 21 initiates a "rock" rhythm pattern; pressing simultaneously the keys 21 and 22 initiates a "waltz" rhythm pattern; pressing simultaneously the keys 20 and 22 initiates an "offbeat" rhythm pattern; and pressing simultaneously all three of the keys 20, 21 and 22 produces a "shuffle" rhythm pattern.

The three keys 23, 24 and 25 in the area designated cymbal perform the same functions as the respective keys 20, 21 and 22 described above except the sounds produced are those of the cymbal. In like manner, the keys 26, 27 and 28 in the area designated snare perform the same functions as the keys 20, 21 and 22 except the sounds produced are those of the snare drum. Further, the keys 29, 30 and 31 in the area designated Tom-Tom 2 perform the same functions as the keys 20, 21 and 22 except the sounds produced are that of the second Tom-Tom drum.

The key 38 of the keyboard 18 is designated "accent". Pressing the key 38 acts to change the sound of the cymbal from that of an open cymbal to that of a closed cymbal. Releasing the key 38 returns the sound to that of an open cymbal. A foot pedal may be connected to the synthesizer 10 to enable the user to control the cymbal accent using his foot, which is the way in which the accent of a conventional "hi hat" cymbal is controlled.

The keys 35, 36 and 37 of the keyboard 18 are used to control the tempo of the musical notes generated by the synthesizer 10. The key 35 is designated "slower"; the key 36 is designated "faster"; and the key 37 is designated "bass drum". The key 37 is used to initiate a continuous series of equally spaced bass drum beat sounds. The rate of the bass drum beats is designated as the tempo and is used to control the rate of the beats and rhythm patterns initiated by the keys 20–31. For example, the slow series of drum beats initiated by the keys 20, 23, 26 and 29 as described above is regulated by the tempo to produce the slow series of beats at a rate of two beats for each of the bass drum beats. In like manner, the medium series of drum beats initiated by the keys 21, 24, 27 and 30 are each regulated at a rate of four beats for each of the bass drum beats; and the fast series initiated by the keys 22, 25, 28 and 31 are each regulated at a rate of eight beats for each of the bass drum beats. Accordingly, setting the tempo of the bass drum automatically sets the tempo of all of the beat patterns initiated by the keys 20–31. The tempo is also used to establish the rate at which the synthesizer records and plays back musical notes, as described in detail below.

The tempo of the bass drum may be set in several ways. Pressing the key 37 initiates the bass drum beat sound, and initially sets the bass drum beat rate to about one hundred beats per minute. This rate may be decreased or increased by pressing, respectively, the key 35 or the key 36. For example, as long as the key 36 is pressed, the rate of the bass drum beats will progressively increase to a maximum of 300 beats per minute. When the rate reaches the desired rate, releasing the key 36 will cause the synthesizer to store and hold that rate. In like manner, the key 35 may be used to decrease the rate to a lower tempo. Each time the bass drum beat is generated, the LED 56 is caused to flash, and may be used as a visual metronome.

The user may set the tempo of the synthesizer in another way, as follows. Musicians are fond of establishing a tempo for their music by tapping out a series of beats using their hand or foot. The synthesizer 10 includes a feature which enables the user to tap out a series of bass drum beats using, simultaneously, the keys 35 and 36. Circuitry within the synthesizer 10 is used to calculate the rate of the tapped beats and to automatically set and hold the bass drum tempo to the rate of occurrence of the last two beats tapped out. A foot pedal may also be connected to the synthesizer 10, the function of which is to allow the user to duplicate the hand function of pressing, simultaneously, the keys 35 and 36, by using his foot to tap the foot switch. In this way, the user may tap out a tempo with his foot which is automatically used to set the tempo of the synthesizer 10.

The bass drum sound may be turned off by again pressing the key 37. However, although the sound will not be heard, the synthesizer 10 will continue to use the last established tempo to control the synthesizer functions described above.

The synthesizer 10 includes a digital microprocessor circuit, discussed in detail below. One of the functions of this circuit is to generate evenly spaced apart clock pulses at a clock rate which is synchronized to the tempo. In a preferred embodiment of the invention, the clock is set sixteen times faster than the tempo. Accordingly, sixteen clock pulses are generated between successive beats of the bass drum. The clock pulses are used to time when the synthesizer 10 will generate a musical sound in response to actuation of the keys 20–31. Unlike striking the drums 40–46, which causes the synthesizer 10 to immediately produce a respective musical beat in response to an analog drum signal generated when the drum is struck pressing the keys 20–31 causes the synthesizer 10 to produce a musical sound only at the occurrence of a clock pulse. For example, if a key 20–31 is pressed prior to a clock pulse being generated, the synthesizer 10 will wait until the next clock pulse before the respective sound is generated. In this way, all of the sounds generated in response to the actuation of the keys 20–31 are automatically synchronized to the tempo of the bass drum.

The synthesizer 10 generates percussion rhythms in response to actuation of the keys 20–31 in the following manner. As each clock pulse is generated, the circuitry within the synthesizer 10 determines if any of the keys 20–31 have been pressed or if any of the drums 40–46 have been struck. If any of these events have occurred, the circuitry generates a respective signal in the form of digital pulses. If the signal generated is in response to the actuation of the keys 20–31, this signal (hereinafter referred to as the rhythm signal) comprising a series of rhythm pulses used to generate the appropriate musical rhythm. If the signal generated is in response to the striking of the drums 40–46 (hereinafter referred to as the digital drum signal), this signal comprises a single digital drum pulse, and no sound is generated. This is so because sounds generated by the synthesizer 10 in response to striking of the drums 40–46 are directly initiated by the analog drum pulses produced as each drum 40–46 is struck. The digital drum signal is used, however, when the synthesizer 10 is performing the recording function as described below.

In summary, the synthesizer 10 generates musical sounds in response both to an analog drum pulse produced by striking the drums 40–46 and to a rhythm signal initiated in response to the actuation of the keys 20–31. The analog drum pulses are produced whenever the drums 40–46 are struck, and the rhythm and digital drum pulses are produced in synchronism with the clock pulses.

Returning to FIG. 1, the remaining keys 32, 33 and 34 of the keyboard 18 are designated, respectively, "stop", "record" and "playback". The keys 32, 33 and 34 are used to control the recording and playback functions of the synthesizer 10. The key 33 acts to initiate the storage of signals representing the various musical notes generated by the synthesizer 10; the key 34 is used to initiate the playback of the musical notes; and the key 32 is used to stop both the record and playback functions.

The recording function of the synthesizer 10 is accomplished by storing digital signals in a semiconductor memory. The digital signals thus stored represent the actuation of the various keys 20–31 and 38 used to initiate the musical sounds generated by the synthesizer 10. The recording function of the synthesizer 10 is also capable of storing digital signals representing each strike of the drums 40–46.

The synthesizer 10 includes three separate memories which may be used to store the digital signals representing the musical notes to be generated. The keys 23, 24 and 25 are used to select which of the three memories are to be used for recording and for playback. The initiation of the recording function, as well as the selection of the memory to be used for recording are both accomplished by pressing simultaneously the record key 33 and either the key 23, 24 or 25, depending on whether the first, second or third memory is to be used for recording. In like manner, the playback key 34 is simultaneously pressed with one of the keys 23, 24 or 25 to both initiate the playback function and to select which of the three memories are to be used for playback. The LEDs 52, 54 and 56 are selectively illuminated during the memory selection process to indicate to the user which of the three memories is being selected. The LED 52 represents the first memory; the LED 56 represents the second memory; and the LED 54 represents the third memory.

The recording function of the synthesizer 10 enables the user to record multiple rhythm patterns in a manner which permits the individual patterns to be interleaved with each other. This is accomplished as follows. Each of the memories used for recording include a plurality of sequentially addressable memory locations. The circuitry within the synthesizer 10 is designed to address sequentially the locations of the memory in a recirculating loop. Thus the circuitry sequentially addresses the locations from the first location to the last location and then returns to the first location to repeat the process.

This looping process is continued until the recording function is terminated by pressing the stop key 32.

The rate at which the memory locations are sequentially addressed is the clock rate described above. Thus, sixteen memory locations are sequentially addressed during the time between successive bass drum beats. A total of two hundred fixty six memory locations are provided for each memory loop. Accordingly, the loop is recirculated for every sixteen beats of the bass drum. It has been found that this memory loop length is sufficient to store a musical phrase typical of the phrases created using percussion instruments. Each of the three memories available for recording include sufficient memory locations to store signals representing rhythms of each of the four percussion instruments as well as to store signals representing the actuations of the accent key 38.

When the recording function is initiated as described above, the particular memory selected is cleared by clearing all data stored in each of the memory locations. Beginning with the first location, the circuitry sequentially addresses each memory location in response to the clock pulses generated at the clock rate.

As each memory location is addressed, the circuitry determines if either a digital drum pulse or a rhythm pulse has been generated. As described above, these pulses are generated in synchronize with the clock pulses. If either of these pulses has been generated, a digital pulse (hereinafter referred to as a beat pulse) is stored in the memory location being addressed, but only if that location does not already contain a beat pulse.

Since all of the locations in the memory have been cleared initially, the first time the circuitry loops through the memory it will not encounter any stored beat pulses. Accordingly, all of the beat pulses generated will be stored. It should be noted that during the recording process the synthesizer continues to generate musical sounds in response to the analog drum and rhythm pulses.

When the circuitry has completed the first loop through the memory, the beat pulses stored therein represent the individual percussion beats produced by the user using the drums 40–46 and the keys 20–31. For subsequent loops through the memory, the synthesizer 10 automatically generates (or plays back) the sounds represented by the stored beat pulses, with each sound being generated as each memory location is addressed. Since each location is addressed at the clock rate, the sounds are played back in synchronism with the tempo established by the keys 35 and 36.

At the same time as the synthesizer is generating sounds in response to the stored beat pulses, it also continues to generate new sounds in response to further striking of the drums 40–46 and actuation of the keys 20–31. In addition, the synthesizer 10 continues to store the beat pulses representing these new sounds.

As noted above, beat pulses can only be stored in memory locations not previously containing the beat pulse. Accordingly, the synthesizer 10 will only store newly created beat pulses in those memory locations which are still unoccupied. This has the effect of interleaving the musical beats of one rhythm with the musical beats of previous rhythms. Thus, each time the synthesizer 10 loops through the memory locations it both plays back the previously recorded rhythms and continues to record new rhythms having beats which fall between the beats of the previous rhythms. The user may continue to play and record additional rhythms until all of the locations in the memory are filled with beat pulses. The user may then record additional rhythms by selecting another of the three memories to be used for recording.

When all of the desired rhythms have been stored, the recording process may be stopped by pressing the stop key 32. Pressing the playback key 34 in conjunction with one of the memory select keys 23–25 causes the synthesizer 10 to playback the recorded rhythms. The user may now play along with the stored rhythms by striking the drums 40–46 or pressing the keys 20–31. However, none of these new rhythms will be recorded when the synthesizer is performing the playback function.

The playback function causes the synthesizer 10 to repetitively loop though the memory locations of the selected memory and to repetitively generate the musical beats represented by each of the stored beat pulses. The rate at which the memory locations are addressed is the clock rate. The user may alter the tempo at which the rhythms are played back by altering the rate of the bass drum beats using the keys 35 and 36 as described above. Thus the rhythms may be played back at a tempo different from the tempo at which they were recorded.

To assist the user in determining when the synthesizer has completed a memory loop, all of the LEDs 48–56 are caused to flash simultaneously each time the first memory location in the loop is being addressed. The LEDs 48–56 are flashed in this manner both in the playback and recording modes and enable the user to time the beginning of a rhythm with the beginning of the loop.

The synthesizer 10 also has the capability to store signals representing the actuation of the accent key 38 (or the actuation of the foot pedal used to control the accent). While in the recording mode, the synthesizer 10 acts to generate a signal (hereinafter referred to as an accent signal) comprising accent pulses . An accent pulse is generated in synchronism with a clock pulse if it is determined that the accent key 38 is pressed. The accent pulse is stored in a designated memory loop in a manner analogous to the storage of the beat pulse. Thus, the accent pulse will be stored in the memory location being addressed if that location does not already contain an accent pulse.

As stated above, the accent feature acts to change the sound of the cymbal sounds produced by striking the drum 42 or by pressing the keys 23–25. The user may use the recording function of the synthesizer 10 to store a series of accent pulses by enabling the recording function and by pressing the key 38 (or the foot pedal) at the desired times. Pressing the key 38 by itself does not produce any sound but does cause the accent pulses to be recorded.

The user may then play back the recorded accent pulses. If the user then initiates a cymbal sound by, for example, striking the drum 42, and if that sound is initiated coincident with one of the accent pulses being played back, the cymbal sound generated will be changed to include the accent.

Figure 2:
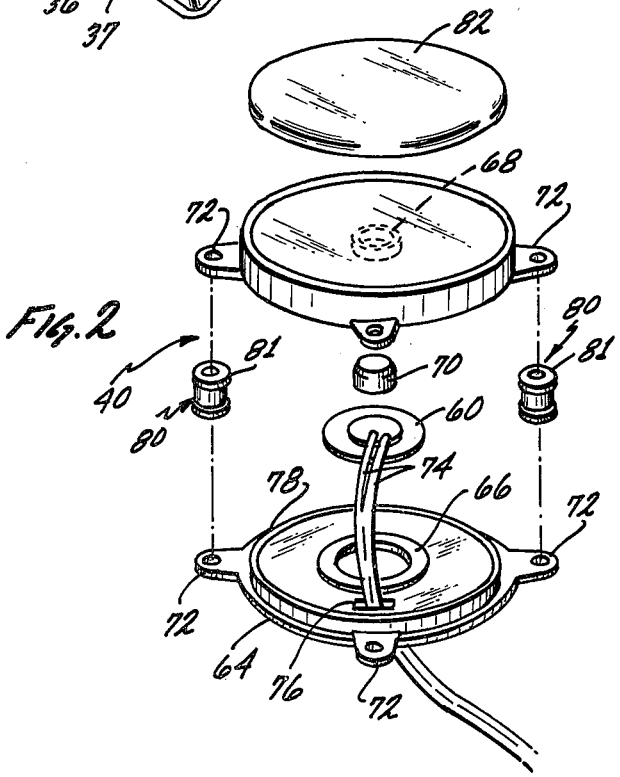
FIG. 2 is an exploded perspective view of one of the drums of the synthesizer.
Figure 3:
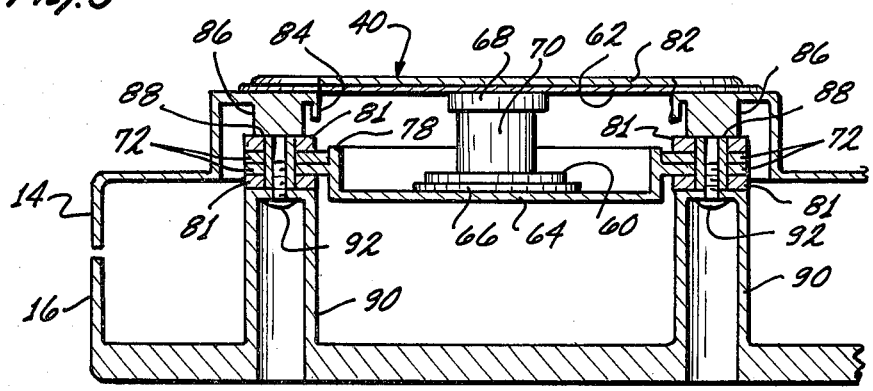
FIG. 3 is a cross-sectional view of the synthesizer taken along the line 3—3 of FIG. 1 to show how the drum of FIG. 2 is mounted to the synthesizer housing.

The construction of the drums 40–46 will now be described with reference to FIGS. 2 and 3. FIG. 2 is an exploded perspective view of the drum 40, and FIG. 3 is a cross-sectional view showing the drum 40 mounted to the housing 12. The drum 40 includes a piezoelectric ceramic disc 60 mounted within a hollow cylindrical enclosure comprising an upper section 62 and a lower section 64. A cylindrical cavity 66 is provided in the center of the lower section 64 to centrally locate the disc 60, and a cavity 68 is provided within the upper section 62 to support one end of a resilient spacer 70. Both the upper section 62 and the lower section 64 include four circumferentially spaced apart lugs 72 having openings therein. Conductors 74 are provided, one end of each of which is connected to one of the terminals of the ceramic disc 60. The conductors 74 are routed through the lower section 64 using a slot 76 provided therein. The upper section 62, containing the spacer 70, is assembled over the lower section 64, containing the disc 60. The section 62 is held to the lower section 64 by a rim 78 provided on the section 64 which tightly engages the inner wall of the section 62. The section 62 is oriented with respect to the section 64 so that the lugs 72 on the respective sections 62 and 64 are aligned. A hollow resilient grommet 80 is installed through the opening in each set of aligned lugs 72, and is retained therein by projecting flanges 81 which snap over each of the lugs 72. A thin pad of resilient material 82 is adhesively fastened to the outer surface of the upper section 62.

The resultant assembly of the drum 40 is shown in FIG. 3. When the upper section 62 and the lower section 64 are fastened together, it can be seen that the resilient spacer 70 extends between the inner wall of the section 62 and the surface of the ceramic disc 60. The spacer 70 is sized to apply a slight amount of pressure to the disc 60 which aides in holding it in place.

The pad 82 forms the striking surface of the drum 40. When the pad 82 is struck (for example, by hitting it with a drumstick) a portion of the striking force is transmitted through the spacer 70 to the disc 60. The disc 60 acts as a pressure transducer and generates an output voltage across the conductors 74 in a manner well known to those skilled in the art. This voltage has an amplitude proportional to the magnitude of the force striking the disc 60, and is used to produce the analog pulse referred to above.

The resilient spacer 70 in conjunction with the upper section 62 and the pad 82 acts to absorb a portion of the striking force to prevent damage to the ceramic disc 60 from the application of excessive force. The amount of force transmitted from the pad 82 to the disc 60 is to some extent a function of where on the pad 82 the force is applied. For example, hitting the pad 82 directly in the center will transmit a greater amount of force to the disc 60 then hitting the pad 82 in an area adjacent to its outer periphery. Accordingly, the amplitude of the output voltage produced by the disc 60 is a function both of the magnitude of the force striking the pad 82 and of the point at which the force is applied to the pad 82.

The drums 42, 44 and 46 shown in FIG. 1 are all constructed in a manner identical to construction of the drum 40. Because all four of the drums 40, 42, 44 and 46 are mounted to the single housing 12, it is important that each of the drums 40, 42, 44 and 46 be mechanically isolated from each other. This isolation is necessary to prevent the force striking one of the drums from being coupled to the other drums. Such cross-coupling can cause the other drums to produce unwanted output signal voltages which in turn causes the synthesizer 10 to generate unwanted musical beats.

FIG. 3 shows how the drum 40 is mounted to the housing 12 in a manner which mechanically isolates it to the extent necessary to prevent coupling to the other drums. The upper section 14 of the housing 12 includes an opening 84 through which the upper section 62 of the drum extends. Bosses 86 extend from the inner surface of the upper section 14. Hollow cylindrical projections 88 extend from the bosses 86 through the openings in the hollow grommets 80 mounted to the drum 40. The bottom end of the projection 88 contacts the upper end of a hollow boss 90 projecting from the inner surface of the lower section 16 of the housing 12. Self tappping screws 92 are used to fasten the hollow boss 90 to the hollow projection 88. These screws 92 serve both to hold together the upper and lower sections 14 and 16, and to retain the drum 40 within the housing 12. The length of the projection 88 is chosen so that the grommet 80 is compressed slightly between the bosses 86 and 90. The projections 88 act in combination with the grommets 80 to center the drum 40 within the opening 84.

From the above description, it can be seen that the only mechanical connection between the drum 40 and the housing 12 is through the four resilient grommets 80. The grommets 80 act to mechanically isolate the drum 40 from the housing 12 in a manner which prevents undesirable mechanical coupling to the housing 12 and to the other drums. The remaining three drums 42, 44 and 46 are mounted to the housing 12 in a manner identical to the mounting of the drum 40. In a preferred embodiment of the invention, the sections 14, 16, 62 and 64 are formed of ABS plastic, the grommets 80 are formed of neoprene, the spacer 70 is formed of neoprene foam, and the pad 82 is formed of vinyl. The disc 60 is approximately twenty seven millimeters in diameter and is preferrably a piezoceramic speaker element supplied by Shigoto Corp., New York.

In accordance with an important aspect of the present invention, it should be noted that the tabs 72 of upper section 62 and lower section 64 are held together by fastener 92 with no intervening mechanical vibration absorbent material. In contrast, the combination of upper section 62 and lower section 64 when assembled are isolated (with respect to vibrations) from housing 14 and therefore from other drum pad assemblies by elastic grommet 80. In addition, once assembled, the spacial relationship between upper section 62 and lower section 64 is maintained such that resilient spacer 70 is held in compression between piezo-electric disc 60 and the underside of upper section 62 thereby assuring that any impact to upper section 62 is transmitted via resilient spacer 70 to piezo electric disc 60.

The drum assembly set forth in FIG. 3 in essence forms a "clam shell-like" structure of upper section 62 and lower section 64 enclosing piezo-electric disc 60 and resilient spacer 70. While resilient grommet spacer 80 reduces the coupling of mechanical vibrations between housing 14 and tabs 72 of upper and lower sections 62 and 64 respectively, large vibrations such as those typically caused by drum pad striking by a player, despite grommet nonetheless passed between housing 14 and tab 72. This imparted vibration would, but for the present invention structure, impart mechanical energy to piezo-electric disc 60 and produce undesired sound. However, in accordance with an important aspect of the present invention, such energy when coupled to tabs 72 cause the entire assembly of upper section 62 and lower section 64 to be moved in unison. As a result, no movement or stress is imposed differentially; that is, between plates 62 and 64 therefore no vibration is imparted to disc 60. In essence, the drum assembly of the present invention "floats" upon resilient spacer 80 and vibrations imparted to the assembly merely cause movement of the entire assembled structure without the imposition of force upon piezo-electric crystal 60. As a result, no electrical output is produced by piezo-electric crystal 60 due to such vibration. Stated simply, piezo-electric crystal 60 responds solely to forces which are applied differentially between upper section 62 and lower section 64 which alter the spacing between sectors 62 and 64. While practitioners in the art will recognize that the elasticity or flexibility of upper section 62 and lower section 64 is largely a matter of design choice, it has been found that optimum combination of piezo-electric response and vibration isolation is achieved if lower section (that is the non-struck section) is fabricated of a substantially more rigid material than upper section 62. When lower section 64 is made of a more rigid material than upper section 62, impact or forces imparted to upper section 62 through resilient overlay 82 by a player are substantially differential due to the rigidity of lower section 64. While some resilience or flexibility of lower section 64 is desireable to provide increase assurance of avoiding damage to piezo electric disc 60, its rigidity with respect to the flexibility of upper section 62 is in essence what assures that forces or impacts applied to upper section 62 do produce differential forces and compression of spacer 70 and thus activate piezo-electric crystal 60.

The maintenance of spacer 70 in a compressive mode in addition to helping retain piezo-electric disc 60 in position firmly against the inside surface of lower section 64, also improves the response of the drum pad to light touches. At the other extreme, piezo-electric disc 60 is protected against excessive forces or impacts upon upper section 62 by the resilience of spacer 70 which acts to absorb large impacts.

As will be appreciated by those skilled in the art, the present invention structure, facilitates the combination in a low-cost mass produced structure of a plurality of drum pads or other impact responsive element in which isolation between such elements is to be maintained. While the present invention structure is for reasons of economy and ease of manufacture fabricated from a molded plastic material, the practitioners in the art will quickly recognize that the multiple drum pads of the present invention could be similarly mounted with equal benefit from the present invention in housing fabricated of other materials such as wood or metal.

Figure 4:
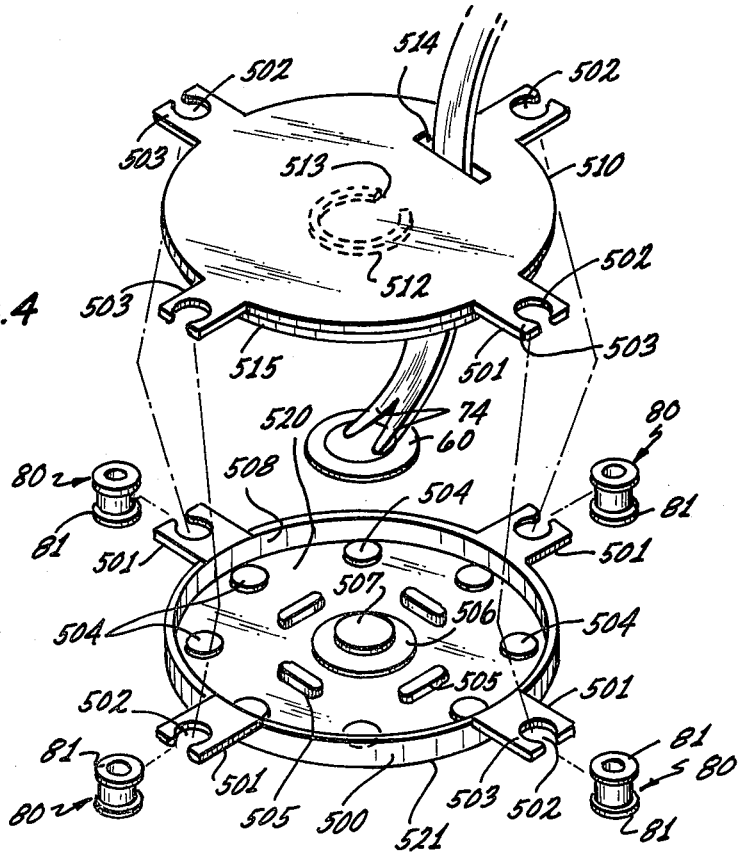
FIG. 4 is an exploded perspective view of an alternate embodiment of a drum constructed in accordance with the present invention.

FIG. 4 shows an alternate embodiment of the present invention structure in which an injection molding insertion technique is used together with certain structural differences from the embodiment shown in FIG. 2 to achieve a more easily manufactured device. The FIG. 4 shown is an exploded view which is reversed top to bottom from that shown in FIG. 2 in that the lower section 64 in FIG. 2 corresponds to section 5–10 in FIG. 4 while upper section 62 in FIG. 2 corresponds to section 500 in FIG. 4. The reversal of section halves in FIG. 4 from that shown in FIG. 2 is solely to facilitate description of the interior prominences of section 500. It should be understood that the structure shown in FIG. 4 is "upside down" in the sense that the mated sections 500 and 510 will be positioned within housing 16 inverted from that shown in FIG. 4, that is with section 500 above and section 510 below.

Section 510 is substantially the same in structure to lower section 64 in FIG. 2 with the exception that tabs 501 extending peripherally outward at quadrature positions about the outer edge of section 510 include a aperture 503 and an opening in the outer wall surrounding the aperture 502, the purpose of which will be described below in greater detail. Also different from the structure shown as lower section 64 in FIG. 2 is the fact that the inner ring 512 on section 510 which corresponds and function to ring 66 on section 64 of FIG. 2 has a discontinuity or open portion or gap 513 positioned opposite the wire lead aperture 514. In all other respects, however, the section 510 is substantially the same in structure and function to that of section 64 in FIG. 2.

Similarly, wire leads 74 which pass through aperture 514 are bonded or electrically connected to piezo-electric disc 60 in a manner similar to that shown in the structure of FIG. 2. The structure of section 500, however, differs from that shown in FIG. 2 and section 62 by the use of an assembly technique known as insertion molding. Simply stated, insertion molding provides the use of a initial molded part formed of a material such as nylon or zytel 101 or any similar plastic material in which a plurality of apertures are provided. After fabrication, the nylon or plastic part is then placed within a still larger mold cavity and a second material such as polyvinylchloride or other resilient material having a lower melting point is then injection molded in a manner by which the second material flows through the apertures in the first material, and when solidifies, acts as a bonding mechanism to maintain the attachment of the second material portion to the first.

In the structure shown in FIG. 4, the section 500 defines a circular substantially planer portion 520 about which there is surrounding a raised portion 508 to which four peripherally extending tabs 501 are attached. Tabs 501, planer section 502 and raised section 508 together with an inner annular raised section 506 are all formed of the same nylon or zytel material and are molded at the samc time into a singular part. Planer section 520 defines a plurality of apertures not visible but which underly molded portions 504, 505, and 507. During the second molding process, the polyvinylchloride material is injection molded to section 500 in a manner in which produces a striking surface 521 extending across the entire plane of portion 520 and corresponding to member 82 in FIG. 2. In addition, during the molding of surface 521, the polyvinylchloride material flows through the apertures in section 500 and forms the appendages 504, 505 and 507. When the material cools and matures to a resilient elastic member, the flowed material and the material within the apertures in section 500 retain overlying surface 521 and the appendages in attachment to section 500.

Appendages 504 are equally spaced about the periphery of surface 520 and serve to maintain striking surface 521 in intimate contact with the planer portion 520 of section 500. In addition, appendages 505 are spaced in quadrature about center ring 506 at positions corresponding to the axis of tabs 501. During assembly when tabs 501 on section 500 and tabs 501 on section 510 are brought into contact and alignment, the corresponding one of appendages 505 which is positioned nearest to aperture 514 serves as a strain relief device to maintain lead wires 74 in a substantially fixed resiliently supported position. In addition, of course, appendages 505 because they are formed in similar manner to appendages 504 also serve to retain surface 521 in contact with section 500. Finally, appendage 507 placed at the center of surface 520 is caused to be molded to a height corresponding to the distance between surface 520 and the proximate surface of piezo-electric disc 60 when all parts are assembled. Appendage 507 serves the same operative function as member 70 in the structure shown in FIG. 2 in that it provides the compressively mounted coupling mechanism for imparting forces applied to surface 521 to disc 60.

During assembly, disc 60 is positioned within center ring 512 and section 510 and 500 are brought together aligning tabs 501 and causing the outer surface 515 of section 510 to nest within raised portion 508 of section 500. With this assembly stage reached, resilient grommets 80 are fitted within apertures 503 of tabs 501 on both sections by deforming them sufficient amounts to pass through opening 502. Once having passed openings 502, the resilient grommets return to their original shape and are retained within apertures 503 in tabs 501 of both sections 510 and 500. When so assembled, the upper rim portions 81 of grommets 80 are positioned on the outer surfaces, that is the non-contacting surfaces of tabs 501, and serve to retain the entire assembly. Thereafter, the structure shown in FIG. 4 may be mounted to a housing similar to that shown in FIG. 3.

The present invention structure provides a simple, easy to assemble and inexpensive structure for providing a maximum of response to impact directed to the drum surfaces while isolating each drum pad element from the other. At the same time, excessive forces to individual drum pads which otherwise damage the piezo-electric element are dampened by flexing of upper and lower sections 62 and 64.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. For use in an electronic musical instrument in which a plurality of electronic drum simulators are supported within a common housing, drum pad means comprising:

an electro-mechanical transducer;

a striking pad for receiving player imparted impacts;

coupling means for coupling mechanical vibrations;

a first housing section defining an outer surface which supports said striking pad and defining a first concave portion;

a second housing section defining a second concave portion; and retaining means isolating said first and second housing sections and said electro-mechanical transducer from said common housing holding said first and said second housing portions in a nested relationship in which said first and second concave portions are mated to form an enclosure and in which said transducer and said coupling means are captivated therein and span a portion of the enclosure thus formed; and whereby vibrations imparted to said striking pad are coupled via said first housing and said coupling means to said transducer causing substantial output signal production while those simultaneously imparted to both said first and said second housing portions by paths other than said striking pad produce substantially reduced output signals.

2. Drum pad means as set forth in claim 1 wherein said first and second housing portions define peripheral portions surrounding their respective concave portions, and a plurality of outwardly extending tabs spaced about said periphery and wherein said retaining means maintain non-resilient fastening between the respective ones of said plurality of tabs of said first and second housing portions.

3. Drum pad means as set forth in claim 2 wherein said tabs each include an aperture and wherein said tabs are spaced about the periphery of said first housing portion in a pattern identical to those of said second housing portion.

4. Drum pad means as set forth in claim 3 wherein said retaining means include a plurality of elastic grommets each defining a reduced cross-section center portion, said grommets being sized to maintain an interference fit within said apertures of said tabs when said first and second housing portions are nested.

5. For use in an electronic musical instrument in which a plurality of electronic drum simulators are supported within a common housing, drum pad means comprising:

a first housing section defining a substantially planar portion having first and second opposed surfaces, a rim portion extending from said second surface, and a plurality of tabs extending outwardly from said rim portions and each defining an aperture;

a second housing section defining a substantially planar portion having first and second opposed surfaces, a rim portion extending from said first surface and passing within said rim of said first housing section, and a plurality of tabs extending outwardly from said rim portion and each defining an aperture spaced in alignment with said plurality of tabs of said first housing section;

a resilient striking pad supported by said first surface of said first housing portion;

a piezo-electric transducer;

a resilient coupler captivating said transducer against said second surface of said first housing section;

connecting means for conducting the electrical signals produced by said transducer; and a plurality of elastic grommets defining reduced cross-sectional area center portions and larger area rib portions at both ends extending through said apertures and maintaining said plurality of tabs of said first housing section and said plurality of tabs of said second housing section in abutment.

6. A drum pad assembly comprising:

a nested pair of inwardly facing cupped members assembled to form an internal cavity;

means resiliently supporting said nested pair of cupped members;

a resilient coupler spanning the cavity thus formed;

an electro-mechanical transducer, producing an electrical signal in response to mechanical vibrations, said transducer interposed between one of said cupped members and said resilient coupler; and connecting means providing an electrical connection to said transducer;

said nested pair of cupped members coupling a great portion of the imparted force to said electro-mechanical transducer when one of said cupped members is struck and said nested pair of cupped members are jointly subject to force or vibration.

* * * * *